US011896880B2

(12) United States Patent
Oldenburg et al.

(10) Patent No.: US 11,896,880 B2
(45) Date of Patent: Feb. 13, 2024

(54) ULTRA HIGH STIFFNESS PUTTER SHAFT

(71) Applicant: Karsten Manufacturing Corporation, Phoenix, AZ (US)

(72) Inventors: John E. Oldenburg, Phoenix, AZ (US); David S. Kultala, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 110 days.

(21) Appl. No.: 17/373,647

(22) Filed: Jul. 12, 2021

(65) Prior Publication Data

US 2022/0008796 A1 Jan. 13, 2022

Related U.S. Application Data

(60) Provisional application No. 63/050,368, filed on Jul. 10, 2020.

(51) Int. Cl.
*A63B 53/10* (2015.01)
*A63B 53/00* (2015.01)

(52) U.S. Cl.
CPC ..... *A63B 53/10* (2013.01); *A63B 53/007* (2013.01); *A63B 2209/023* (2013.01)

(58) Field of Classification Search
CPC .. A63B 53/007; A63B 53/10; A63B 2209/023
See application file for complete search history.

(56) References Cited

U.S. PATENT DOCUMENTS

| | | | | |
|---|---|---|---|---|
| 5,569,098 | A * | 10/1996 | Klein | A63B 53/007 473/316 |
| 5,971,865 | A * | 10/1999 | Shenoha | A63B 53/02 473/316 |
| 6,261,500 | B1 * | 7/2001 | Park | B29C 53/562 264/258 |
| 6,572,490 | B2 | 6/2003 | Ashida | |
| 6,872,151 | B2 | 3/2005 | Ashida | |
| 6,935,969 | B2 | 8/2005 | Kumamoto | |
| 7,404,771 | B2 | 7/2008 | Kumamoto | |
| 7,736,245 | B2 | 6/2010 | Hasegawa | |
| 7,803,063 | B2 | 9/2010 | Kumamoto | |
| 7,967,698 | B2 | 6/2011 | Kato | |
| 8,021,244 | B2 | 9/2011 | Kato | |
| 8,292,755 | B2 | 10/2012 | Wakabayashi et al. | |
| 8,376,875 | B2 | 2/2013 | Nakamura et al. | |
| 8,491,406 | B2 | 7/2013 | Bone | |
| 8,491,410 | B2 | 7/2013 | Kato | |
| 8,827,829 | B2 | 9/2014 | Nakano | |
| 8,852,021 | B2 | 10/2014 | Matsumoto et al. | |
| 8,915,796 | B2 | 12/2014 | Yashiki | |

(Continued)

FOREIGN PATENT DOCUMENTS

| | | |
|---|---|---|
| JP | 2006218080 | 8/2006 |
| JP | 2018171391 A * | 11/2018 |

*Primary Examiner* — Joshua T Kennedy

(57) ABSTRACT

A golf club shaft used with putter type club heads for making a putting stroke on the green of a golf course is made from high-modulus fibers which results in an ultra-high stiffness putter shaft with high frequency, low tip deflection, and high torsional and bending rigidity. The ultra-high stiffness putter shaft prevents unwanted face twisting during the impact of a golf ball during a putting stroke, allowing for greater putt accuracy.

19 Claims, 8 Drawing Sheets

(56) References Cited

U.S. PATENT DOCUMENTS

| | | | | |
|---|---|---|---|---|
| 8,920,266 | B2 | 12/2014 | Takeuchi | |
| 8,936,515 | B2 | 1/2015 | Yashiki | |
| 8,936,516 | B2 | 1/2015 | Yashiki | |
| 9,211,454 | B2 | 12/2015 | Matsunaga | |
| 9,339,700 | B2 | 5/2016 | Oyama | |
| 9,339,702 | B2 | 5/2016 | Hasegawa | |
| 9,358,437 | B2 | 6/2016 | Ehlers | |
| 9,498,687 | B2 | 11/2016 | Nakamura | |
| 9,550,098 | B2 | 1/2017 | Wahl et al. | |
| 9,566,485 | B2 | 2/2017 | Hasegawa et al. | |
| 9,586,106 | B2 | 3/2017 | Yashiki | |
| 9,597,566 | B2 | 3/2017 | Ishihara et al. | |
| 9,713,753 | B2 | 7/2017 | Nakamura | |
| 9,757,625 | B2 * | 9/2017 | Nakano | A63B 53/10 |
| 9,795,847 | B2 | 10/2017 | Nakamura et al. | |
| 9,802,365 | B2 | 10/2017 | Fraidenburgh | |
| 9,878,225 | B2 | 1/2018 | Kogawa et al. | |
| 9,925,435 | B2 | 3/2018 | Hicks | |
| 9,931,552 | B2 | 4/2018 | Yoshihiro et al. | |
| 9,993,705 | B2 | 6/2018 | Yashiki | |
| 2013/0137530 | A1 * | 5/2013 | Ito | A63B 60/00 473/319 |
| 2013/0165250 | A1 * | 6/2013 | Takeuchi | A63B 60/54 473/319 |
| 2013/0260911 | A1 * | 10/2013 | Ito | A63B 60/00 473/319 |
| 2014/0106895 | A1 * | 4/2014 | Hasegawa | A63B 60/00 473/319 |
| 2016/0367872 | A1 * | 12/2016 | Naito | A63B 60/00 |
| 2017/0259138 | A1 * | 9/2017 | Nakamura | A63B 53/10 |
| 2018/0001166 | A1 * | 1/2018 | Nakano | A63B 53/0466 |
| 2018/0043223 | A1 * | 2/2018 | Wakabayashi | A63B 60/00 |
| 2019/0151731 | A1 | 5/2019 | Sclafani | |
| 2019/0290978 | A1 | 9/2019 | Mordasini et al. | |
| 2020/0122006 | A1 * | 4/2020 | Adams | A63B 60/02 |
| 2020/0164254 | A1 | 5/2020 | Nakamura | |

* cited by examiner

ULTRA HIGH STIFFNESS PUTTER SHAFT

CROSS-REFERENCES

This claims priority of U.S. Provisional Patent Application No. 63/050,368, filed on Jul. 10, 2020, the contents of which is fully incorporated herein by reference.

TECHNICAL FIELD

This disclosure relates generally to golf clubs, and relates more particularly to putter shafts.

BACKGROUND

Golf club shafts can be produced to have various stiffness values based on the needs of a specific golfer. For most golf clubs, bending and torsional deflection of the shaft can be beneficial to the performance of the club through effects on dynamic loft, droop, face angle and closure rate. Proper matching of shaft stiffness and torque are integral to the fitting process. Golfers with higher swing speeds typically benefit from stiffer shafts and golfers with lower swing speeds benefit from more flexible shafts. However, for putters there is little to no benefit to having a flexible shaft that experiences shaft displacement. A flexible putter shaft will result in deflection of the putter head, leading to changes in face and loft angles of the putter. These changes in face and loft angle affect the dynamics of the impact, leading to inaccuracies during a putt. A flexible putter shaft will allow unwanted putter head twisting (dynamically altered face angle) when a ball is struck off center. Therefore, there is a need in the art for an ultra-high stiffness putter shaft that reduces twisting and limits shaft tip deflection during a putt.

DEFINITIONS AND METHODS OF MEASUREMENT

Figure 1:
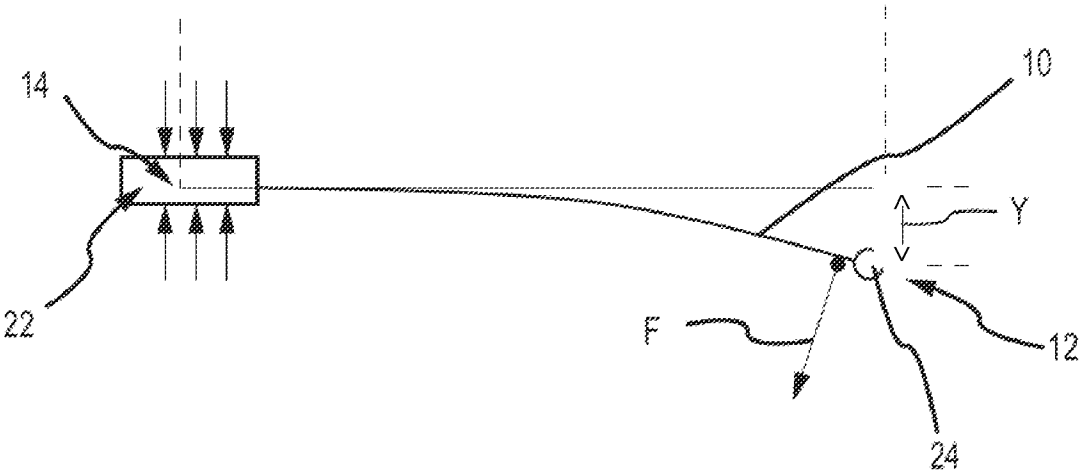
FIG. 1 illustrates a shaft mounted in an apparatus for measuring tip deflection of the shaft.

Referring to FIG. 1, as used herein, the term "shaft frequency" means a number of oscillations that an end of the shaft 10 undergoes per unit time, after an input force F excites the shaft 10. The frequency of a shaft 10 corresponds to the overall stiffness and bending properties of the shaft 10. A higher frequency signifies a stiffer shaft. The shaft frequency can be measured by: (1) clamping the butt end 14 of the shaft 10, (2) installing a 205 g tip weight 24 onto the tip end 12 of the shaft 10, (3) exciting the tip end 12 of the shaft by displacing it a distance Y and releasing it, and (4) capturing the resulting frequency oscillations with an accelerometer. The frequency can be measured between the first 2 to 10 oscillation cycles.

Referring to FIG. 1, as used herein, the term "tip deflection" means a distance Y of a shaft 10 is the distance that a shaft tip end 12 is displaced by an applied load F. The tip deflection Y of the shaft 10 corresponds to the bending properties and regional stiffness of the shaft 10. In some embodiments, the tip deflection Y is measured to quantify the shaft lower section stiffness. As illustrated in FIG. 1, tip deflection Y of a shaft can be measured by: (1) clamping 6 inches of the shaft 10 at the butt end 14, (2) applying a load F of approximately 3.9 lbs perpendicularly to the shaft 10 at one inch inward from the tip end 12, and (3) measuring the perpendicular displacement of the tip end 12 of the shaft from the at-rest position of the shaft.

As used herein, the term "torsional stiffness" means an angle of twist that the shaft exhibits with respect to a torque load. The torsional stiffness of a putter shaft determines the amount of dynamic change in face angle during a putt. To measure torsional stiffness, the shaft can first be clamped at the tip and butt ends. In some measurement methods, 6 inches of the upper section is clamped (in other words, 6 inches of the butt end is clamped) and 1 inch of the lower section is clamped (in other words, 1 inch of the tip end is clamped). A torque load (of 1 ft*lbs in some embodiments) can then be applied to the tip or butt end of the shaft. The resulting twist angle of the shaft correlates to the torsional stiffness of the shaft.

Longitudinal plies, defined below, contribute primarily to the bending stiffness of the shaft. Bias plies, defined below, contribute primarily to the torsional stiffness of the shaft. Golf regulations require that a shaft have equal torsional response in every direction, so for every +45 degree bias ply there must be a corresponding −45 degree bias ply. More specifically, the United States Golf Association (USGA) Equipment Rules, Part 2, section b. (Bending and Twisting Properties) requires that "at any point along its length, the shaft must: (i) bend in such a way that the deflection is the same regardless of how the shaft is rotated about its longitudinal axis; and (ii) twist the same amount in both directions." (Source: https://www.usga.org/equipment-standards/equipment-rules-2019/equipment-rules/equipment-rules.html#!ruletype=er&section=rule&partnum=2&rulenum=3, accessed Jul. 7, 2020).

As used herein, the term "shaft axis" means a reference axis defined down the center of the shaft, parallel to the length of the shaft.

As used herein, the term "tubular laminate body" means a component that forms the shaft between a tip end and a butt end, defined below. The tubular laminate body is roughly cylindrical. In other words, a cross-section of the shaft taken orthogonal to the shaft axis would reveal a circular shape. The tubular laminate body can be formed from longitudinal plies and bias plies.

As used herein, the term "longitudinal plies" refers to plies that have fibers oriented parallel to the shaft axis, defining a zero-degree fiber orientation. As used herein, the term "bias plies" refers to plies have fibers oriented not parallel to the shaft axis. Bias plies fibers can be angled from the longitudinal ply fibers. For example, bias plies can be angled from longitudinal plies by +/−45 degrees, +/−90 degrees, or any other angle between 0 degrees (not included) and 90 degrees (included).

As used herein, the term "outer diameter" means the diameter of the shaft, measured around an outer surface of the shaft. Hereafter, the term outer diameter is abbreviated as "OD."

As used herein, the term "inner diameter" means the diameter of the shaft, measured within a hollow interior of the shaft. The inner diameter (hereafter abbreviated as "ID") will always be less than the outer diameter (OD) within a single cross-section of the shaft. [AC1]

As used herein, the term "wall thickness" of the shaft means a value equal to the OD minus the ID, measured within a single cross-section of the shaft. For a composite shaft, the wall thickness is also known as the cured ply thickness, or CPT.

As used herein, the term "tip end" means an end of the shaft that is configured to couple to a club head.

As used herein, the term "butt end" means an end of the shaft, opposite the tip end and configured to be covered by a grip. A golfer will hold the golf club grip, at the shaft butt end, when using the golf club. The shaft butt end has an OD that is greater than the OD of the shaft tip end. The shaft butt end also has an ID that is greater than the ID of the shaft tip end.

Figure 3:
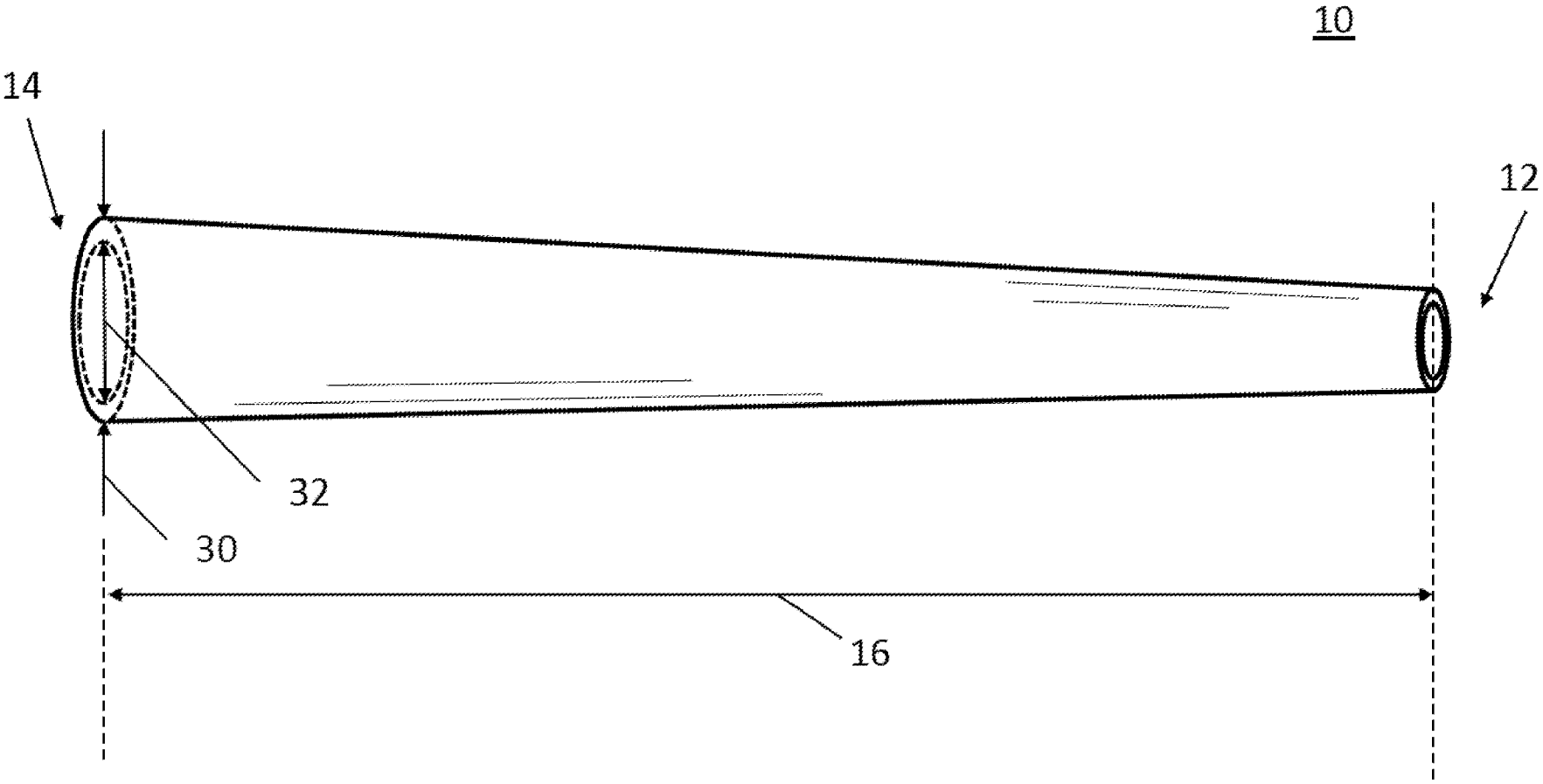
FIG. 3 illustrates a putter shaft, according to an embodiment.

Referring to FIG. 3, as used herein, the term "shaft length 16" is the distance between the tip end 12 and the butt end 14. As used herein, the term "entire length" can mean 100% of the shaft length 16. As used herein, the phrase "substantially the entire length" can mean over 80% or over 90% of the shaft length 16.

DESCRIPTION

The ultra-high stiffness putter shaft comprises a higher stiffness than existing shafts, as evidenced by a higher frequency, a smaller tip deflection, and a lower torque. Shaft stiffness can be quantified in several ways: frequency in oscillations per unit time (such as cycles per minute, cpm), tip deflection in distance (such as inches), and torque in angle per unit of load (such as degrees/ft-lb). The ultra-high stiffness putter shaft can exhibit a frequency greater than 650 cpm, a tip deflection of less than 1.0 inch (2.54 cm), and a torsional stiffness of less than 1.5 degrees. The ultra-high stiffness putter shaft can be stiff in both bend (putt-aligned deflection) and torsional (twist/face angle deflection) directions. During a putt, the ultra-high stiffness putter shaft, described herein, provides more consistent ball speed across the putter face, better accuracy, and improved feel.

Referring to FIG. 3, the putter shaft 10 can comprise an upper section adjacent a butt end 14 and a lower section adjacent a tip end 12, having a high level of stiffness as measured by tip deflection, frequency, and/or torsional stiffness. At least a portion of the upper section can be configured to receive a grip or be encapsulated by a grip (not shown). The tip end 12 of the lower section can be configured to connect to a golf club head. In some embodiments, the lower section of the putter shaft 10 can comprise a stiffness that is different from the upper section of the shaft 10. In other embodiments, the lower section and the upper section can have the same stiffness. The frequency, tip deflection, and torsional stiffness of the ultra-high stiffness putter shaft can individually and/or together represent the stiffness of substantially the entire length of the shaft.

The ultra-high stiffness putter shaft exhibits a frequency of greater than 650 cpm. In some embodiments, the putter shaft exhibits a frequency of greater than 660 cpm, greater than 670 cpm, greater than 680 cpm, greater than 690 cpm, greater than 700 cpm, greater than 720 cpm, greater than 740 cpm, greater than 760 cpm, greater than 780 cpm, greater than 800 cpm. In some embodiments, the frequency of the ultra-high stiffness shaft is in the range of 650-800 cpm, more specifically in the range of 650-700 cpm, 700-750 cpm, or 750-800 cpm. In some embodiments, the ultra-high stiffness putter shaft exhibits a frequency no lower than 650, no lower than 660 cpm, no lower than 670 cpm, no lower than 680 cpm, no lower than 690 cpm, no lower than 700 cpm, no lower than 720 cpm, no lower than 740 cpm, no lower than 760 cpm, no lower than 780 cpm, or no lower than 800 cpm. The frequency of the ultra-high stiffness putter shaft is higher than traditional steel shafts, which typically have stiffnesses from 440-460 cpm. Even industry-available shafts that are marketed as high stiffness putter shafts exhibit frequencies lower than 650 cpm. For example, prior art putter shafts have frequencies of 465-475 cpm, 475-580 cpm, or 580-600 cpm.

The ultra-high stiffness putter shaft exhibits a tip deflection of less than 1.0 inch. In some embodiments, the putter shaft exhibits a tip deflection of less than 0.9 inch, less than 0.8 inch, less than 0.7 inch, less than 0.6 inch, or less than 0.5 inch. In some embodiments, the ultra-high stiffness putter shaft exhibits a tip deflection of no greater than 1.0 inch, no greater than 0.9 inch, no greater than 0.8 inch, no greater than 0.7 inch, no greater than 0.6 inch, or no greater than 0.5 inch. The here described putter shaft has a lower tip deflection than traditional steel shafts, which typically have tip deflection of around 1.5 inches. Industry-available shafts that are marketed as high stiffness putter shafts exhibit tip deflections of greater than 1.0 inch. For example, prior art putter shafts can have a tip deflection of 1.1 inch to 1.4 inches.

The torsional stiffness of the instant ultra-high stiffness putter shaft ranges from 0.5 to 1.0 degree per foot-pound. In some embodiments, the torsional stiffness of the putter shaft ranges from 0.5 to 0.6 degree/ft*lb, 0.6 to 0.7 degree/ft*lb, 0.7 to 0.8 degree/ft*lb, 0.8 to 0.9 degree/ft*lb, or 0.9 to 1.0 degree/ft*lb. In some embodiments, the torsional stiffness of the putter shaft is no greater than 1.0 degree/ft*lb, no greater than 0.9 degree/ft*lb, no greater than 0.8 degree/ft*lb, no greater than 0.7 degree/ft*lb, no greater than 0.6 degree/ft*lb, or no greater than 0.5 degree/ft*lb. In contrast, the torsional stiffness of existing shafts is typically greater than 1.0 degree/ft*lb. For example, prior art putter shafts can have torsional stiffnesses of 1.0 degrees/ft*lb to 2.0 degrees/ft*lb.

Figure 2:
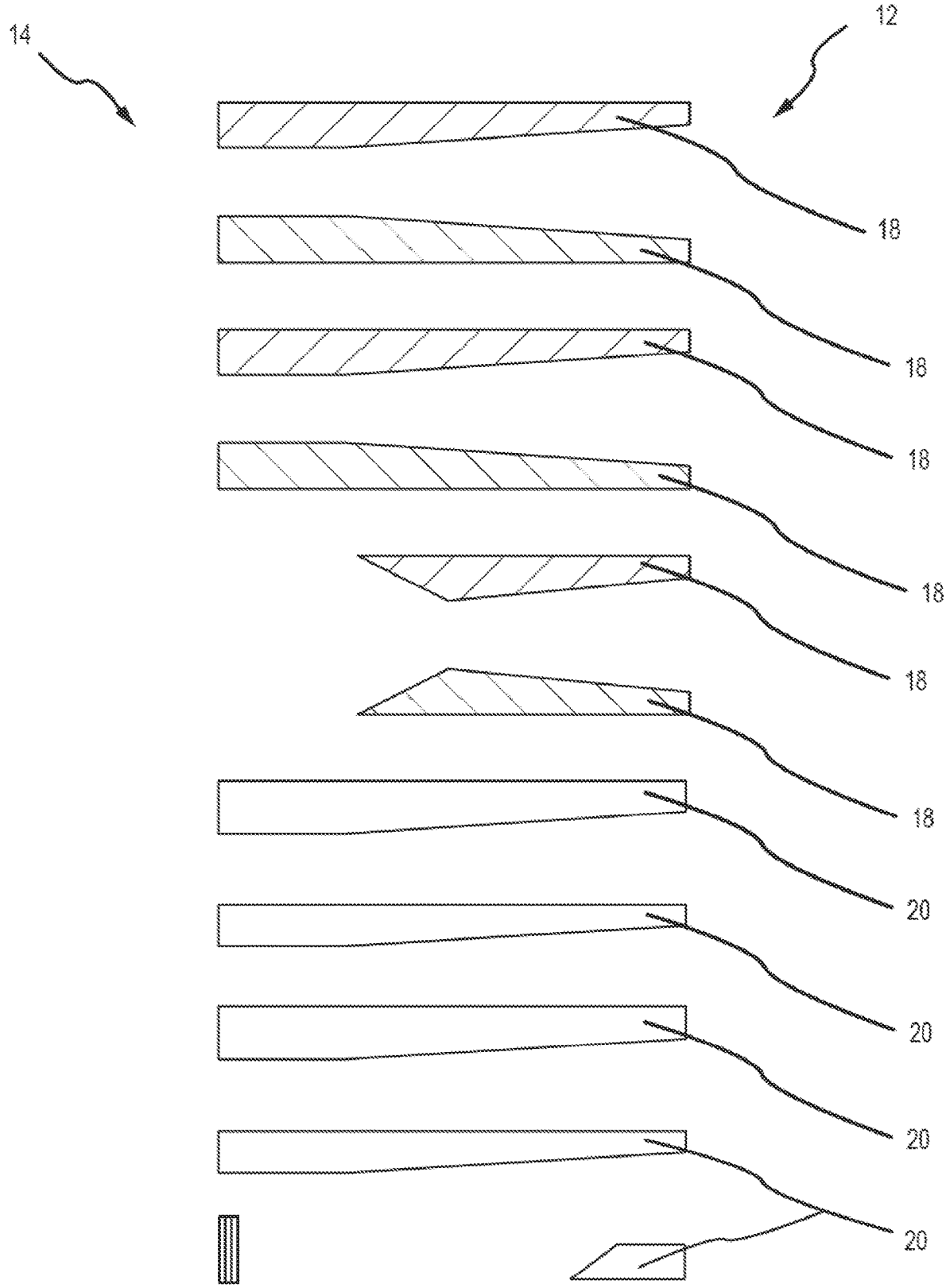
FIG. 2 illustrates a layup pattern for a shaft, according to an embodiment.

Referring to FIG. 3, the ultra-high stiffness putter shaft 10 can comprise a tubular (or roughly cylindrical) laminate body. FIG. 2 illustrates a sample layup for a laminate body. The laminate body can be formed from uni-directional (UD) fiber plies, including longitudinal plies 20 and bias plies 18. The longitudinal plies 20 can also be called zero plies or bend control plies. The longitudinal plies 20 have fibers oriented parallel to the shaft axis, defining a zero-degree fiber orientation. The bias plies 18 can also be called torque control plies. The bias plies 18 have fibers oriented plus or minus 45 degrees from the longitudinal plies 20 (also from the shaft axis).

The tubular laminate body can comprise 8 to 30 plies. Most plies can wrap around a mandrel twice, forming two layers of the shaft for each ply. In some embodiments, the laminate body can comprise a total of 8 to 10, 10 to 12, 12 to 14, 14 to 16, 16 to 18, 18 to 20, 20 to 22, 22 to 24, 24 to 26, 26 to 28, or 28 to 30 laminate and bias plies (and a number of layers double the number of plies). The laminate body can comprise 4 to 6, 4 to 8, 4 to 10, 4 to 12, 4 to 14, 4 to 16, 4 to 18, 4 to 20, 5 to 7, 5 to 9, 5 to 11, 5 to 13, 6 to 8, 6 to 10, 6 to 12, 8 to 10, 8 to 12, 8 to 14, 10 to 16, 10 to 18, or 10 to 20 bias plies (and a number of layers double the number of plies). In some embodiments, the laminate body can comprise 2, 3, 4, 5, 6, 7, 8, 9, 10, 11, 12, 13, 14, 15, 16, 17, 18, 19, or 20 bias plies. The bias plies of the tubular laminate body can form a torque core that controls the twisting of the shaft 10. Typical putter shafts (i.e. steel shafts or graphite shafts with standard or intermediate modulus fibers, as defined below), have 2 to 6 bias plies forming the torque core (equating to 4 to 12 layers). In some embodiments, the putter shaft 10 described herein comprises more than 4, more than 5, more than 6, more than 7, more than 8, more than 9, or more than 10 bias plies.

The longitudinal plies 20 can wrap around the torque core to form an outer portion (or bend control sheath), which affects shaft bending. The laminate body can comprise 2 to 8, 3 to 7, 4 to 6, 4 to 7, 4 to 8, 4 to 9, 4 to 10, 4 to 11, or 4 to 12 longitudinal plies. In some embodiments, the laminate body can comprise 2, 3, 4, 5, 6, 7, 8, 9, 10, 11, or 12 longitudinal plies. The tubular laminate body can be formed from a combination of full-length and partial-length plies. In some embodiments, the laminate body can comprise 4 full-length bias plies and 4 full-length longitudinal plies. In another embodiment, the laminate body can comprise 6 to 10 full-length bias plies and 6 full-length longitudinal plies. In some embodiments, the bias plies can each have a thickness of approximately 0.0043 inch. In some embodiments, the longitudinal plies can each have a thickness of approximately 0.003 inch. A greater number of plies can result in a greater wall thickness and thus a higher stiffness. However, a greater number of plies can also increase the OD and/or shaft mass, so it is preferable to use only the necessary number of plies for achieving the desired stiffness. High or ultra-high modulus materials can be used to increase stiffness without adding additional plies.

The tubular laminate body can have a wall thickness that ranges from 0.030 inch and 0.100 inch. The wall thickness can range from 0.030 to 0.040 inch, 0.040 to 0.050 inch, 0.050 to 0.060 inch, 0.060 to 0.070 inch, 0.070 to 0.080 inch, 0.080 to 0.090 inch, 0.090 to 0.100 inch. The tubular laminate body can have different numbers of layers (or plies) within different sections of the shaft. The different number of layers within various sections of the shaft can result in the tubular laminate body having different wall thicknesses along the length 16 of the shaft. For example, in some embodiments, at least a portion of the lower section of the shaft, near the tip end, can have a greater wall thickness. Sections of increased wall thickness can be used to control the location of the shaft center of gravity (CG). In some embodiments, one or more layers of a high-density material are included in the multi-material laminate composite body to achieve a specific CG location.

To form a thickened region within the shaft lower section, between 2, 3, 4, 5, or 6 additional layers can be incorporated into the laminate body within the lower section. The thickened region can begin at 5 to 20 inches from the tip end of the shaft. In some embodiments, the thickened region can start at 5 to 10 inches, 10 to 15 inches, or 15 to 20 inches from the tip end.

Referring to FIG. 3, the shaft inner diameter (ID) 32 and outer diameter (OD) 30 can be greatest at the butt end and smallest at the tip end, as is typical in golf shafts. The diameter tapers gently from the butt end to the tip end. In some embodiments, the ID 32 and OD 30 taper at the same rate. However, when the thickness of the tubular laminate body varies along the shaft length, the ID 32 and OD 30 can taper at different rates.

As is typical in putter shafts, for embodiments having a tip end 12 that is inserted into a club head hosel (i.e. a taper tip putter), the shaft 10 can comprise a tip end ID inclusively between 0.06 inch and 0.20 inch. In some embodiments, the tip end ID can be inclusively between 0.06 inch and 0.08 inch, 0.08 inch and 0.10 inch, 0.10 inch and 0.12 inch, 0.12 inch and 0.14 inch, 0.14 inch and 0.16 inch, 0.16 inch and 0.18 inch, or 0.18 inch and 0.20 inch. The shaft can comprise a tip end OD inclusively between 0.25 inch and 0.45 inch, preferably between 0.30 inch and 0.40 inch. The shaft tip end OD can be inclusively between 0.25 inch and 0.30 inch, 0.30 inch and 0.35 inch, 0.35 inch and 0.40 inch, or 0.40 inch and 0.45 inch. The OD of the shaft affects the aesthetics of the shaft, altering a golfer's perception of the shaft and ability to feel comfortable aligning the putter.

In some embodiments, the shaft can have a parallel tip end region (not shown). The parallel tip can be configured to fit over a hosel peg extending upwards from the club head. In parallel tip embodiments, the parallel tip ID can be between 0.20 inch and 0.46 inch, preferably between 0.30 and 0.40 inch. The parallel tip ID can be between 0.20 inch and 0.25 inch, 0.25 inch and 0.30 inch, 0.30 inch and 0.35 inch, 0.35 inch and 0.40 inch, 0.40 inch and 0.46 inch. In some embodiments, the parallel tip ID is 0.36 inch. The parallel tip ID can match the size of the hosel peg of the club head. In some parallel tip embodiments, the parallel tip OD can be inclusively between 0.30 inch to 0.50 inch, preferably between 0.39 inch and 0.41 inch. The parallel tip OD can be inclusively between 0.30 inch and 0.35 inch, 0.35 inch and 0.40 inch, 0.40 inch and 0.45 inch, or 0.45 inch and 0.50 inch. In some embodiments, the parallel tip OD can be 0.40 inch.

As seen in FIG. 3 and as is typical in golf shafts, the diameter profile of the shaft tapers from the butt end towards the tip end, causing the butt end to comprise an OD 30 that is greater than the tip end OD 30. The shaft can comprise a butt end OD 30 that is inclusively between 0.5 inch and 0.7 inch, preferably between 0.56 inch to 0.62 inch. The outer surface of the butt end is typically covered by a grip. In some embodiments, the shaft 10 can comprise a large OD 30, such as up to 1.2 inch, to compensate for a thin grip. In other embodiments, the shaft 10 and grip together have a combined diameter of up to 1.2 inch, up to 1.4 inch, up to 1.6 inch, up to 1.8 inch, or up to 2.0 inch.

The profile of the shaft diameter from the tip end 12 to the butt end 14 can be identified by sampling the diameter at certain distances from the tip end 12. For example, the shaft 10 can have the OD profile outlined in Table I, below. 1

TABLE I

Example Shaft OD Profile

| Distance from tip end | Shaft outer diameter (OD) |
|---|---|
| 0 inch (i.e. at tip end) | 0.345 inch |
| 6 inches | 0.430 inch |
| 12 inches | 0.500 inch |
| 18 inches | 0.540 inch |
| 22 inches | 0.585 inch |

Alternately, the shaft OD profile can be approximately defined by the following equation that relates the distance from the tip end ("x") and the OD ("y"):

$$y=0.0106x+0.3574$$

In some embodiments, the shaft OD profile can be approximately defined by the following equation:

$$y=0.011x+0.345$$

As evidenced by these equations, the shaft OD increases as the distance from the tip end increases. Because some putter shafts comprise a butt end region with a uniform OD, the above equations can apply to a portion of the shaft length 16. For example, the above equations can apply to about 50%, about 60%, or about 70% of the shaft length 16. In other embodiments, the equations apply to substantially the entire shaft length 16. Due to the known tradeoff between OD and stiffness (smaller OD yields lower stiffness), to increase stiffness without changing OD requires altering the materials of the composite layup.

The ultra-high stiffness putter shaft can comprise a composite material, such as a graphite composite. The graphite composite can comprise a resin and reinforcing fibers. The resin can be a pitch-based or pan-based resin. In some embodiments, the resin can comprise an epoxy. The reinforcing fibers can be carbon fibers (also called graphite fibers) or glass fibers. The makeup of the graphite composite determines the characteristics of the material. [AC2]

Graphite composites can be categorized into standard modulus graphite (33-38 msi tensile modulus), intermediate modulus graphite (42-45 msi), high intermediate modulus graphite (47-50 msi), high modulus graphite (55-57 msi), and ultra-high modulus graphite (greater than 65 msi). In some embodiments, the ultra-high stiffness putter shaft can comprise at least a portion formed from a material with a modulus at or above 60 msi, at or above 65 msi, at or above 70 msi, or at or above 75 msi. For example, a pitch-based graphitic carbon with a modulus of about 70 msi or greater can be used to form either the longitudinal or bias plies.

The bias plies can exhibit an ultra-high modulus. In some embodiments, the bias plies can be a composite with a modulus of approximately 65 msi, such as the Toray M50J composite material. The longitudinal plies can exhibit a high intermediate modulus. In some embodiments, the longitudinal plies can be a composite with a modulus of approximately 50 msi, such as the Toray T1100 composite material.

To achieve the desired bending stiffness and torsional stiffness, the longitudinal plies can comprise high intermediate modulus and/or high modulus graphite composite, and the bias plies can comprise high modulus graphite and/or ultra-high modulus graphite. In some embodiments, the longitudinal plies can comprise a graphite composite with a modulus ranging from 48 to 56 msi. In some embodiments, the longitudinal plies can comprise a graphite composite with a modulus ranging from 48 to 50 msi, 50 to 52 msi, 52 to 54 msi, or 54 to 56 msi. The bias plies can comprise a graphite composite with a modulus ranging from 53 to 70 msi. In some embodiments, the bias plies can comprise a graphite composite with a modulus ranging from 53 to 54 msi, 54 to 56 msi, 56 to 58 msi, 58 to 60 msi, 60 to 62 msi, 62 to 64 msi, 64 to 66 msi, 66 to 68 msi, or 68 to 70 msi. The material used to form the longitudinal plies can be selected to control the desired bending stiffness. The material used to form the bias plies can be selected to control the desired torsional stiffness.

Referring to FIG. 3, the ultra-high stiffness putter shaft 10 comprises a length 16, measured from the butt end 14 to the tip end 12. In some embodiments, the putter shaft length 16 can range from 25 inches to 48 inches. More specifically, the putter shaft length 16 can range from 30 inches to 42 inches. In some embodiments, the putter shaft length 16 can be 30 inches, 31 inches, 32 inches, 33 inches, 34 inches, 35 inches, 36 inches, 37 inches, 38 inches, 39 inches, 40 inches, 41 inches, or 42 inches.

The ultra-high stiffness putter shaft comprises a mass. In some embodiments, the mass of the putter shaft can range from 100 grams to 160 grams. In preferred embodiments, the mass of the putter shaft can range from 115 grams to 135 grams. The mass of the putter shaft can be 115 grams, 116 grams, 117 grams, 118 grams, 119 grams, 120 grams, 121 grams, 122 grams, 123 grams, 124 grams, 125 grams, 126 grams, 127 grams, 128 grams, 129 grams, 130 grams, 131 grams, 132 grams, 133 grams, 134 grams, or 135 grams.

The ultra-high stiffness putter shaft comprises a center of gravity (CG) location. The CG location is expressed as a ratio, which is found by dividing the CG distance measured from the butt end 14 by the total length 16 of the shaft 10. The ultra-high stiffness putter shaft can comprise a CG location ranging from 42% to 52%. In some embodiments, the CG location can be 42%, 43%, 44%, 45%, 46%, 47%, 48%, 49%, 50%, 51%, or 52%.

A stiffer shaft can be especially beneficial for putters having greater head mass and longer shaft lengths. Putters with greater head mass are more likely to droop during a putt than putters with lower head mass. Similarly, for a given stiffness value, a longer shaft will allow the head to deflect more than a shorter shaft. The ultra-high stiffness shaft can be used in a blade type putter, a mid-mallet type putter, a mallet type putter, or any other putter type.

Ratios

The ultra-high stiffness putter shaft 10 combines an aesthetically pleasing size (OD profile), a desirable shaft mass, and an ultra-high stiffness construction with a frequency greater than 650 cpm, a tip deflection of less than 1.0 inch (2.54 cm), and a torsional stiffness of less than 1.5 degrees (achieved via layup and materials). A stiff shaft could be made by using an unusually large OD or by greatly increasing wall thickness. However, these options would result in an undesirable appearance and/or additional mass that would adversely affect shaft performance. Therefore, the relationships between size, mass, and stiffness are important to the overall shaft performance.

The ultra-high stiffness putter can exhibit a ratio of frequency to tip end OD that is inclusively between 1444 cpm/inch and 3200 cpm/inch, or any intermediate range, such as between 1600 cpm/inch to 2700 cpm/inch. In some embodiments, the frequency to tip end OD ratio can be inclusively between 1444 cpm/inch and 1800 cpm/inch, 1800 cpm/inch and 2000 cpm/inch, 2000 cpm/inch and 2400 cpm/inch, 2400 cpm/inch and 2800 cpm/inch, or 2800 cpm/inch and 3200 cpm/inch. The ultra-high stiffness putter can exhibit a ratio of torsional stiffness to tip end OD that is inclusively between 1.0 deg./ft*lb*inch and 4.0 deg./ft*lb*inch, or any intermediate range, such as between 1.7 deg./ft*lb*inch and 3.3 deg./ft*lb*inch. Prior art putter shafts typically have low material modulus values, so the tip end OD would need to be greatly enlarged to achieve frequency values of greater than 650 cpm. Conversely, prior art shafts with a normal tip end OD do not achieve frequency values of greater than 650 cpm, as shown in Example 2 below.

The ultra-high stiffness putter can exhibit a ratio of frequency to shaft mass that is inclusively between 4.0 cpm/gram and 8.0 cpm/gram, or any intermediate range, such as between 4.8 cpm/gram and 7.0 cpm/gram. In some embodiments, the frequency to shaft mass ratio is inclusively between 4.0 cpm/gram and 5.0 cpm/gram, 5.0 cpm/gram and 6.0 cpm/gram, 6.0 cpm/gram and 7.0 cpm/gram, 7.0 cpm/gram and 8.0 cpm/gram. Ultra-high stiffness shafts, having a frequency greater than 650 cpm, could be constructed by increasing the number of ply layers that form the shaft. However, the extra layers would increase the shaft mass, thus undesirably altering the feel and performance of the shaft. The herein described ultra-high stiffness putter shaft comprises both a typical shaft mass and a frequency greater than 650 cpm, achieved via layup design and high and ultra-high modulus materials. Prior art shafts do not exhibit the aforementioned ratio, because they fail to achieve a high stiffness (frequency greater than 650 cpm), while also having a typical shaft mass.

The ultra-high stiffness putter can exhibit a ratio of torsional stiffness to shaft mass that is inclusively between 0.003 deg./ft*lb*gram and 0.010 deg./ft*lb*gram, or any intermediate range, such as between 0.004 deg./ft*lb*gram and 0.009 deg./ft*lb*gram. In some embodiments, the torsional stiffness to shaft mass ratio is inclusively between 0.003 deg./ft*lb*gram and 0.004 deg./ft*lb*gram, 0.004 deg./ft*lb*gram and 0.005 deg./ft*lb*gram, 0.005 deg./ft*lb*gram and 0.006 deg./ft*lb*gram, 0.006 deg./ft*lb*gram and 0.007 deg./ft*lb*gram, 0.007 deg./ft*lb*gram and 0.008 deg./ft*lb*gram, 0.008 deg./ft*lb*gram and 0.009 deg./ft*lb*gram, or 0.009 deg./ft*lb*gram and 0.010 deg./ft*lb*gram. Prior art shafts do not exhibit the aforementioned ratio, because they fail to achieve a high tortional stiffness (less than 1.5 degrees of rotation), while also having a typical shaft mass.

Since the tip end OD and the shaft mass both affect putter aesthetics and performance, the ultra-high stiffness putter shaft can also be characterized by a defining ratio between stiffness and a combination of tip end OD and shaft mass. A first defining ratio ($R_F$) can use frequency[TB3], which suggests a bending stiffness of the shaft. The frequency defining ratio, $R_F$, is defined by the equation below:

$$R_F = \frac{\text{Frequency}}{10{,}000 \times (\text{Tip end } OD) + \text{Mass}}$$

The ultra-high stiffness putter shaft can exhibit a frequency defining ratio, RF, that is inclusively between 5.5 and 8.0, or any intermediate range, such as between 5.6 and 6.9. In some embodiments, RF is inclusively between 5.5 and 6.0, 6.0 and 6.5, 6.5 and 7.0, 7.0 and 7.5, or 7.5 and 8.0. When calculating RF, the frequency is measured in cpm, the tip end OD is measured in inches, and the mass is measured in grams [TB4]. Prior art shafts do not exhibit the aforementioned ratio, because they fail to achieve a high frequency (above 650 cpm), while also having a thin tip end and a typical shaft mass.

A second defining ratio ($R_T$) can use torsional stiffness. The torsional defining ratio, $R_T$, is defined by the equation below:

$$R_T = \frac{\text{Tortional Stiffness}}{10{,}000 \times (\text{Tip end } OD) + \text{Mass}}$$

The ultra-high stiffness putter shaft can exhibit a torsional defining ratio, $R_T$, that is inclusively between 0.004 and 0.010, or any intermediate range, such as between 0.004 and 0.009. In some embodiments, RT is inclusively between 0.004 and 0.005, 0.005 and 0.006, 0.006 and 0.007, 0.007 and 0.008, 0.008 and 0.009, or 0.009 and 0.010. When calculating $R_T$, the torsional stiffness is measured in deg./ft*lb, the tip end OD is measured in inches, and the mass is measured in grams. Prior art shafts do not exhibit the aforementioned ratio, because they fail to achieve a high tortional stiffness (less than 1.5 degrees of rotation), while also having a thin tip end and a typical shaft mass.

A third defining ratio ($R_S$) can use torsional and bending stiffness, with bending stiffness measured through frequency. The stiffness defining ratio, $R_S$, is defined by the equation below:

$$R_S = \frac{\text{Frequency}}{\text{Torsional Stiffness}}$$

The ultra-high stiffness putter shaft can exhibit a stiffness defining ratio, $R_S$, that is inclusively between 650 and 1600, or any intermediate range, such as between 800 and 1300. In some embodiments, $R_S$ is inclusively between 650 and 750, 750 and 850, 850 and 950, 950 and 1000, 1000 and 1100, 1100 and 1200, 1200 and 1300, 1300 and 1400, 1400 and 1500, or 1500 and 1600. When calculating $R_S$, the frequency is measured in cpm and the torsional stiffness is measured in deg./ft*lb. Prior art shafts do not exhibit the aforementioned ratio, because they fail to achieve a high tortional stiffness (less than 1.5 degrees of rotation), while also having a thin tip end and a typical shaft mass.

Advantages

A putt can deviate from its desired course because of face angle or loft angle deviation at impact, among other factors. Toe droop can also introduce error into a putt by causing off center ball impact. Toe droop occurs when a toe end of the putter head swings lower than a heel end of the putter head. Shaft bending can alter the attitude of the putter head at impact, specifically causing a change in effective putter loft angle and toe droop. The change in the attitude of the putter head affects initial launch and roll characteristics of the putt, which ultimately control overall roll distance.

Figure 4:
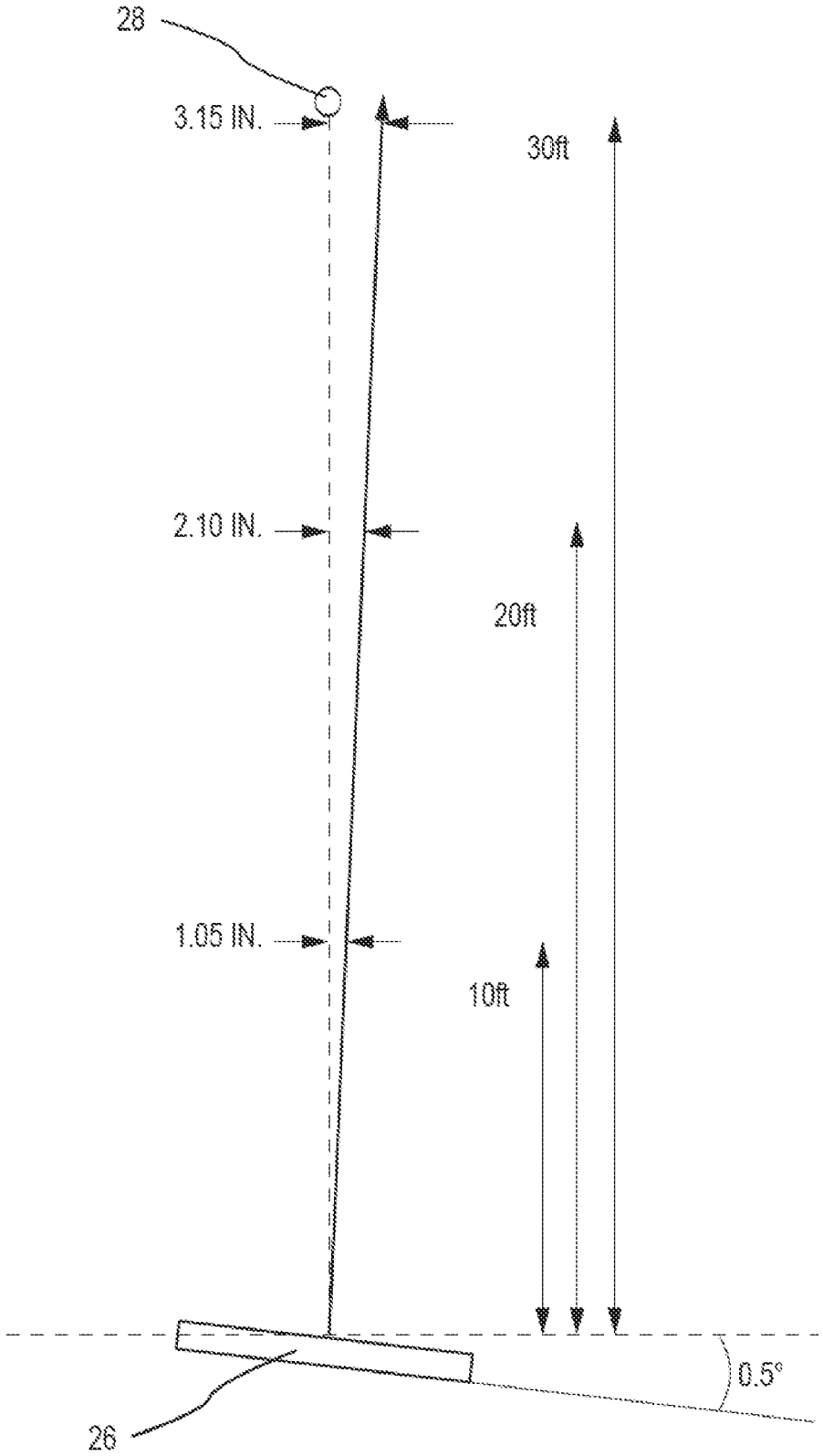
FIG. 4 illustrates an example path deviation caused by a face angle deflection of 0.5 degrees.

Referring to FIG. 4, the torsional stiffness of a putter shaft 10 determines the face angle deviation during a putt. A higher stiffness results in less face angle deviation. A non-zero face angle at the time of impact, either by misalignment or dynamic deflection, will cause deviation in the intended path, illustrated as a dotted line. The intended path is directed towards a hole or target 28. As illustrated in FIG. 4, a slight torsional deflection of the putter head 26 can result in significant deviation from the intended path, especially for longer putts. The deviation path is shown with a solid line. For example, a torsional deflection of only 0.5° at the time of impact results in a deviation from intended path of 1.05 inches on putt of 10 feet; 2.10 inches on putt of 20 feet; and 3.15 inches on a putt of 30 feet. A stiff shaft results in a more consistent face angle that keeps the ball closer to the intended path and lands the golf ball closer to the hole 28.

In addition to the performance benefits, the graphite composite material can also improve the feel, compared to using a stiff metal material. Typical steel shafts impart a stinging or sharp feeling to the golfer when the putter head impacts the ball. This sensation increases as stiffness increases. Therefore, as shown in Example 5 below, it is desirable to form the shaft with a graphite composite material that dampens the stinging feeling.

EXAMPLES

Example 1

Exemplary Layup

In an exemplary shaft, illustrated in FIG. 2, the tubular laminate body can comprise 4 full-length bias plies 18, 2 partial-length bias plies 18 (tip bias plies), 4 full-length longitudinal plies 20, and 1 partial-length longitudinal plie 20. Each ply can form two layers of the shaft. Each of the partial-length bias plies 18 (tip bias plies) runs from the shaft tip 12 to approximately 19 inches from the tip (i.e.the thickened region begins 19 inches from the tip end 12). The tip bias plies 18 add thickness and strength to the tip end 12 of the shaft 10. All the bias plies 18 form a torque core, having 12 layers and a combined thickness of approximately 0.052 inch in the tip end. In the butt end 14, the torque core has 8 layers and a combined thickness of approximately 0.035 inch. The bias plies 18 can be alternatingly oriented at plus and minus 45 degrees from the shaft axis orientation (0 degrees).

The longitudinal plies 20 (oriented at 0 degrees) can form an outer portion of the shaft 10. The 4 full-length plies can form 8 layers of the shaft. The longitudinal plies 20 can each comprise a thickness of approximately 0.003 inch. The longitudinal plies 20 form an outer portion (or bend control sheath) of the shaft. The combined thickness of the outer portion layers can be approximately 0.025 inch. The exemplary shaft, produced with the layup described above, was tested and compared to prior art shafts, as described in Examples 2-5 below.

Example 2

Comparison of Stiffness Parameters

A comparison test was done between a high-stiffness composite putter shaft, as described in Example 1 above, a steel putter shaft, and three market-available putter shafts. Frequency, tip deflection, and torsional stiffness were measured for each shaft. The results are shown in Table II below.

TABLE II

Parameters for Example 2.

| | Frequency | Tip Deflection | Torsional Stiffness |
|---|---|---|---|
| Ultra-high stiffness putter shaft | 650+ cpm | 0.75 in. | 0.8 deg. |
| Steel putter shaft | 440 cpm | 1.5 in. | 1.7 deg. |
| BGT Stability Shaft | 580 cpm | 1.1 in. | 1.1 deg. |
| LA Golf TP-Z | 470 cpm | 1.4 in. | 2.0 deg. |
| Fujikura MC (X-Firm) | 630 cpm | 1.0 in. | 1.9 deg. |

Table II shows that the exemplary putter shaft has the highest frequency response with a frequency of 650+ cpm with the next closest putter being Fujikura MC (x-firm) with a frequency of 630 cpm. Further, the exemplary putter shaft has a tip-deflection value and torsional stiffness value of 0.75 inches and 0.8 degrees respectively. As shown in Table II, the market-available shafts do not achieve the low tip deflection and low torsional values that are achieved by the herein described ultra-high stiffness putter shaft.

Example 3

Putt Speed

A test was conducted to measure the ball speed imparted by an exemplary putter compared to a control putter. The exemplary putter had an ultra-high stiffness putter shaft, similar to the shaft described above. The control putter had a standard steel putter shaft. The control putter and the exemplary putter were identical, except for their shafts. Both putters were heel shafted, with the shaft connected heel-side of face center (i.e. heelward) on each putter head. The effect of the different putter shafts was measured through two parameters: ball speed and smash factor. Smash factor is the ball speed divided by the club head speed. The ball speed and smash factor were measured for impacts 0.75 inch heelward (i.e. heel-side of face center), 0.5 inch heelward, at face center, 0.5 inch toeward (i.e. toe-side of face center), and 0.75 inch toeward.

Figure 5:
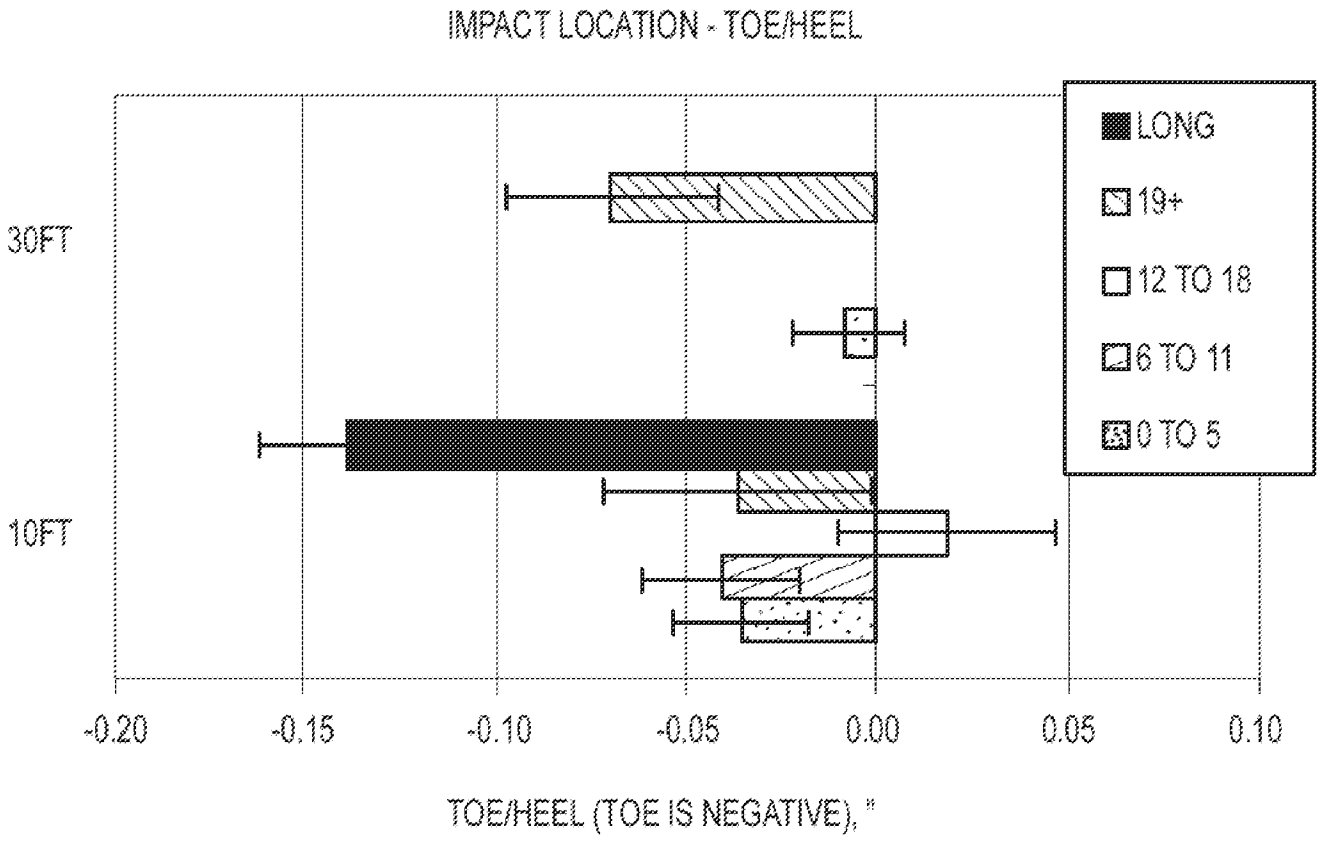
FIG. 5 illustrates an impact location chart that shows face impact location tendencies (measured toe to heel with zero being face center) for different lengths of putts.
Figure 6:
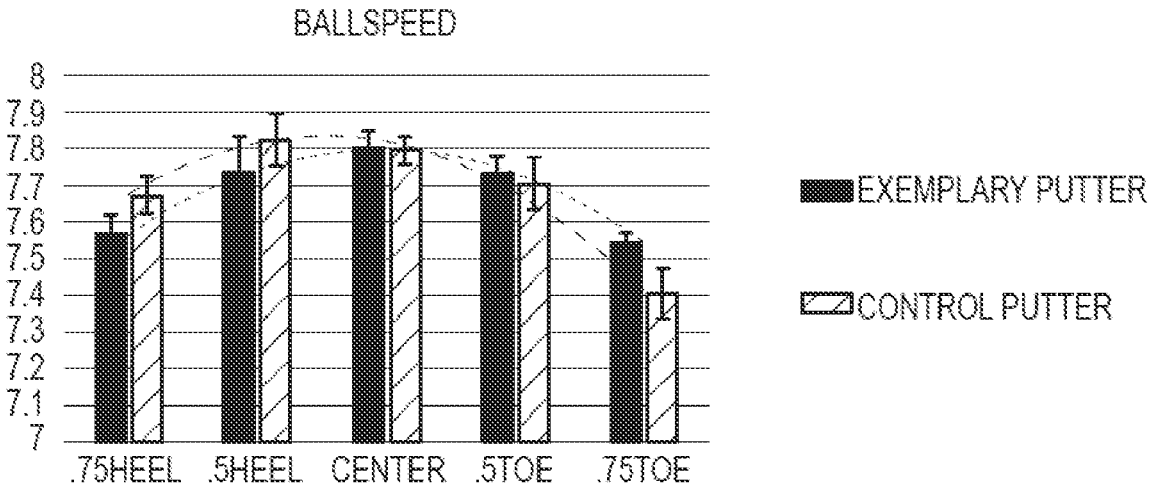
FIG. 6 illustrates ballspeed results from a comparison test between an exemplary putter and a control putter.

FIG. 6 illustrates the ball speed results from the comparison test. The exemplary putter, with its ultra-high stiffness shaft, exhibited higher ball speed for impacts toe-side of center. The exemplary putter demonstrated ball speeds for heelward and toeward impacts that were similar for equal displacement in the heel and toe directions. In contrast, the control putter imparted higher ball speed for heelward impacts and lower ball speed for toeward impacts. In other words, the control putter exhibited more variation in ball speed while the exemplary putter exhibited more consistent ball speeds across the face. Having a more consistent ball speed across the face is beneficial because the ball is more likely to travel its intended distance. In turn, this allows the putt to finish closer to the hole on miss hits. Further, FIG. 5 illustrates that a golfer is more likely to miss hit a ball on the toe during a putt. A miss hit on the toe with the exemplary putter shaft will result in a ball speed closer to that of one struck in the center. In contrast, a miss hit on the toe with the control putter shaft will result in a ball speed that is much lower than a strike in the center.

Figure 7:
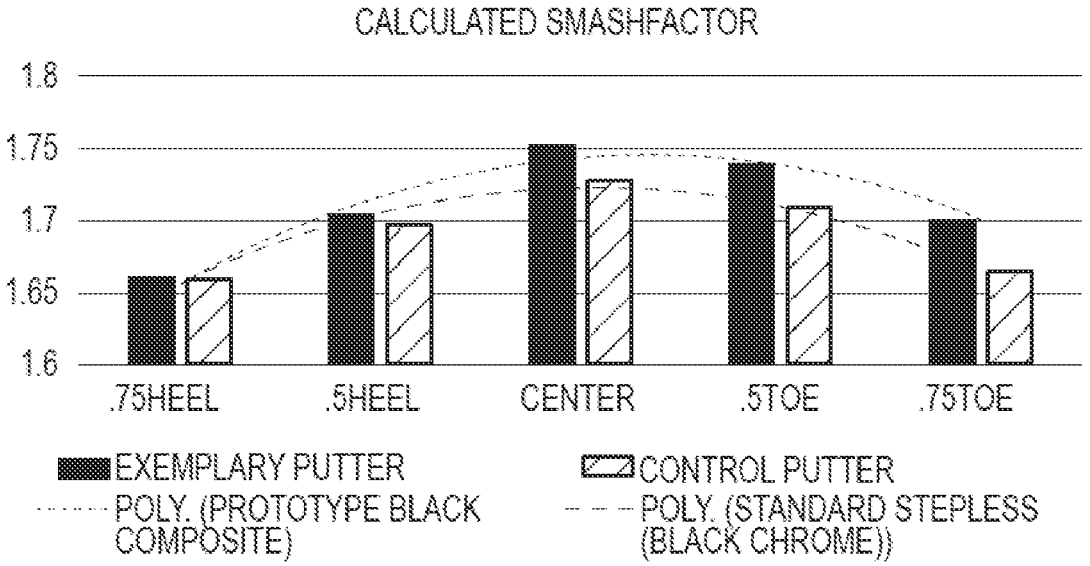
FIG. 7 illustrates calculated smashfactor results from a comparison test between an exemplary putter and a control putter.

FIG. 7 illustrates the smash factor results, calculated from the ball speed and club head speed data. The exemplary putter, with its ultra-high stiffness shaft, exhibited a higher smashfactor for all impacts except at 0.75 inches in the heel. The center and toe strikes had a greater smashfactor difference (from the control) than the heel strikes. Since smashfactor is the ratio of ball speed to club head speed, smashfactor measures the efficiency of a ball strike. As shown by its higher smashfactor, the exemplary putter is more efficient than the control putter at transferring energy to the ball. This high efficiency is due to the ultra-high stiffness shaft. More energy is transferred through the shaft to the golf ball, because less energy consumed deflecting the shaft. It is desirable for a putter face to impart uniform ball speed across the face, so that the putt response feels the same no matter where the ball impacts the face. The uniform ball speed response gives a golfer more consistency in putt distance. Therefore, the exemplary putter, with the ultra-high stiffness shaft not only improves putt accuracy by physically minimizing deflection, but also by improving feel.

Example 4

Accuracy; Statistical Area Plot

Figure 8:
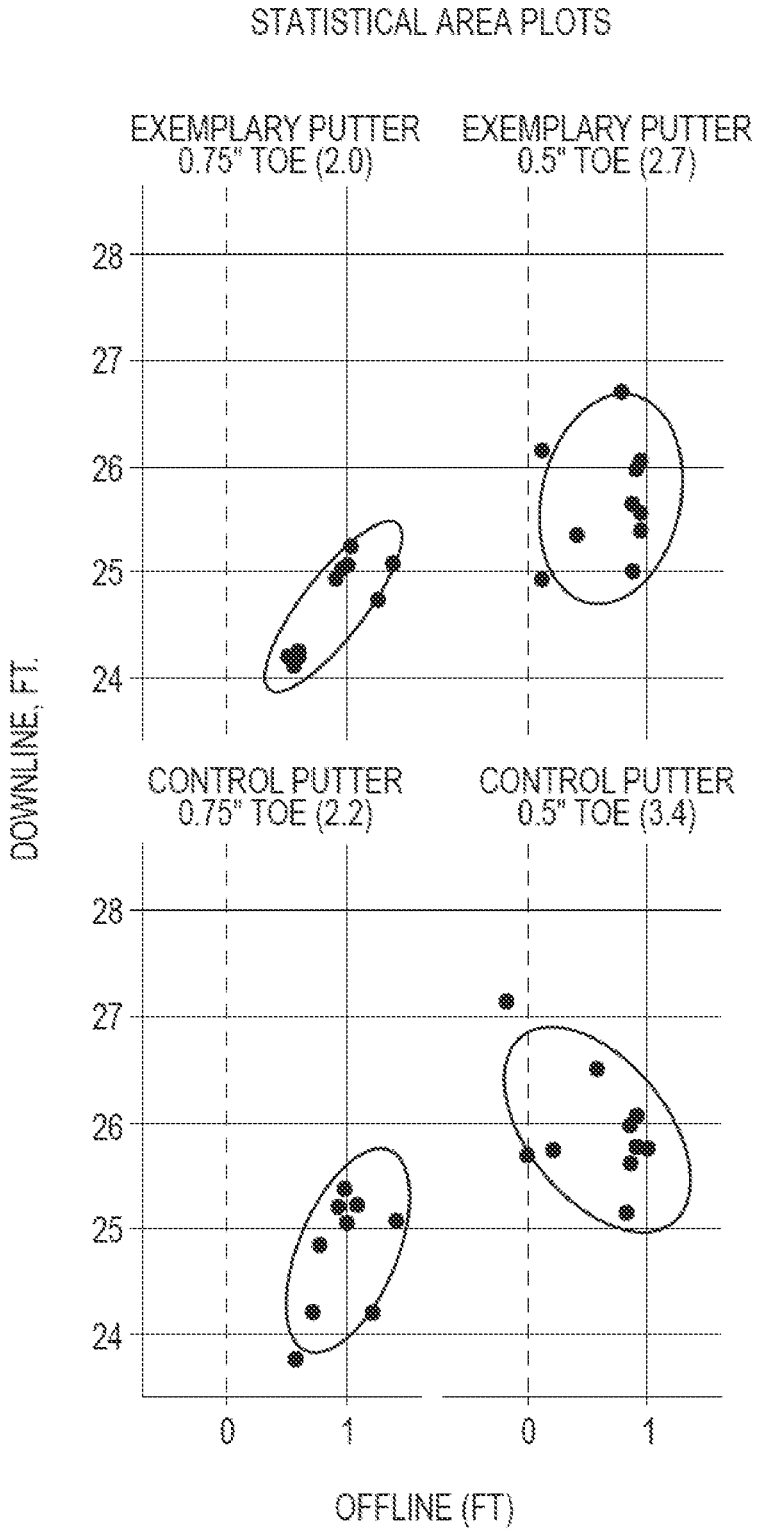
FIG. 8 illustrates statistical area plots from a comparison test between an exemplary putter and a control putter.

A test was conducted to measure the accuracy of toe putts (i.e. putts where the ball impacts toeward of center) for the exemplary club head and the control club head, described above. FIG. 8 illustrates a statistical area plot, showing the results of the comparison test. The statistical areas, shown as ellipses in FIG. 8, each represent an average area within which the putts landed. A smaller statistical area signifies greater accuracy. Both putters were measured for strikes 0.75" toeward of center and 0.5" toeward of center. During the test, ten putts were taken with each putter, for each strike location.

The exemplary putter had a statistical area of 2.0 and 2.7 for strikes in the 0.75" toe region and 0.5" toe region, respectively. In contrast, the control putter had a stat area of 2.2 and 3.4 in the 0.75" toe region and 0.5" toe region, respectively. Comparatively, the ultra-high stiffness putter had a smaller statistical area, meaning it was more accurate. Since the ultra-high stiffness shaft has high torsional and bending rigidity, the shaft twists less on impact, and in turn, the face angle will twist less on impact. The effects of the high torsional rigidity is more noticeable on toe impacts due to the increased torque that toe impacts generate.

Example 5

Feel

Figure 9:
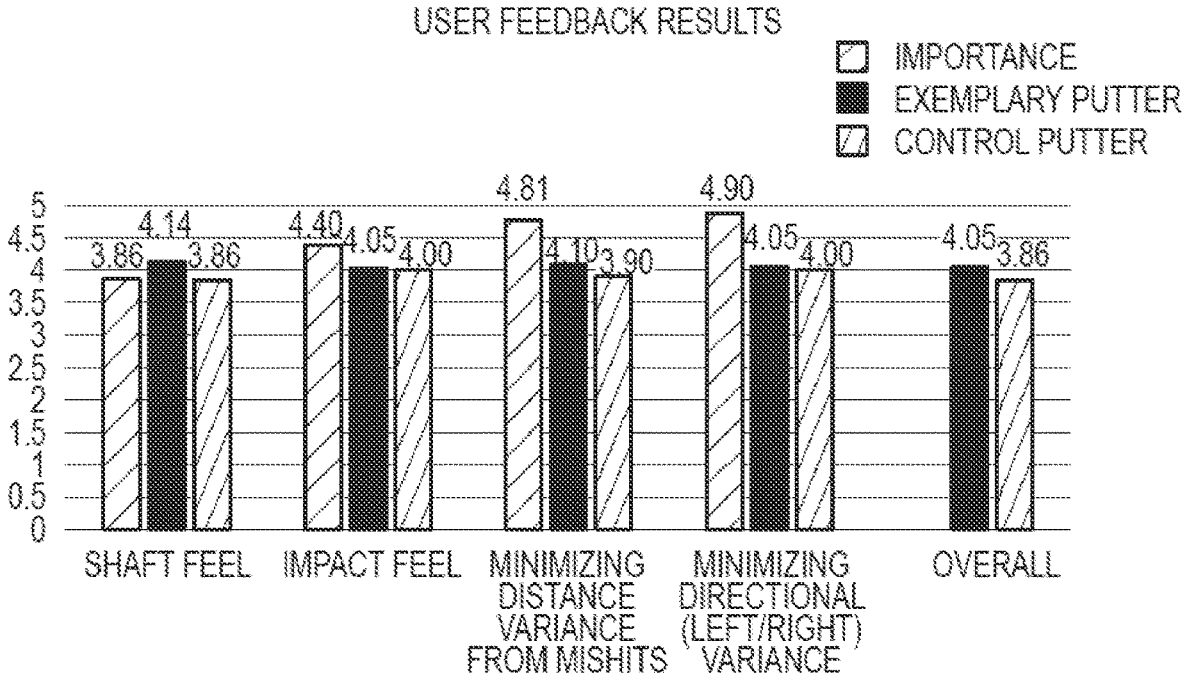
FIG. 9 illustrates user feedback results from a comparison survey between an exemplary putter and a control putter.

FIG. 9 illustrates qualitative feedback from users. The participants of the test were asked a series of questions. The first portion of questions asked the user to rank the importance, on a scale of 1 to 5, of shaft feel, impact feel, minimizing distance variance from miss hits, and minimizing directional variance of a putter. Then the participants were asked to evaluate the performance of each putter in the same categories mentioned above, as well as an overall category. When surveyed, the users were unaware as to the differences between each club. The results of the survey concluded that the exemplary putter received a higher average score in all the categories than the control putter (standard steel shaft).

Figure 10:
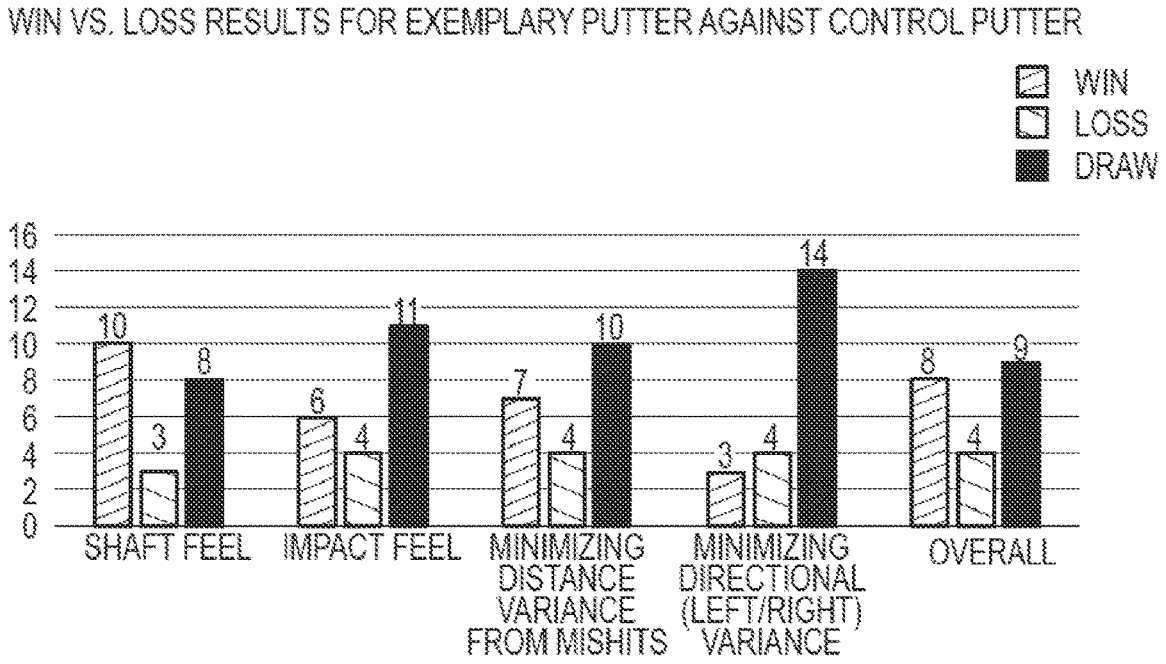
FIG. 10 illustrates user win vs. loss results from a comparison survey between an exemplary putter and a control putter.

FIG. 10 illustrates how many 'wins' or 'losses' the exemplary putter head had in each category. The participants were asked to pick either the exemplary putter, the control putter, or neither, based on performance for each category. If the user picked the exemplary putter, this was recorded as a 'win'. If the user picked the control putter, this was recorded as a 'loss'. If the user picked neither or the same, this was recorded as a 'draw'. The results of the survey concluded that the exemplary putter had more 'wins' than the control putter except in the category "minimizing directional variance," where the exemplary putter had 1 more loss than win. In the overall category, the exemplary putter was preferred over the control putter.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A putter shaft comprising:

a tubular body comprising:

a torque core formed of bias plies;

wherein: the torque core bias plies comprise a graphite composite with a modulus greater than 60 msi, an outer portion formed of longitudinal plies;

wherein: the outer portion longitudinal plies comprise a graphite composite with a modulus value between 54 msi and 56 msi, a tip end; and a butt end;

wherein:

the putter shaft has a length, measured between the tip end and the butt end, that is inclusively between 32 inches and 38 inches;

the putter shaft has a shaft mass inclusively between 115 grams and 135 grams;

the torque core comprises four full-length bias plies and two partial-length bias plies;

the outer portion comprises four full-length longitudinal plies;

each bias ply and each longitudinal ply wrap around twice to form two layers within the tubular body; and the putter shaft comprises an ultra-high stiffness as evidenced by:

a frequency value of greater than 650 cycles per minute (cpm);

a tip deflection of less than 1.0 inch (2.54 cm); and a torsional stiffness of less than 1.5 degrees;

wherein the frequency value is the number of oscillations that the tip end undergoes per minute when a first 6 inches of the butt end is clamped, a 205 gram weight is attached onto the tip end, and the tip end has been displaced and released; wherein the frequency value is measured within the first 2 to 10 oscillation cycles;

wherein the tip deflection is the perpendicular displacement of the tip end of the putter shaft from an at-rest position of the putter shaft when a first 6 inches of the butt end is clamped and a 3.9 lb load is applied perpendicularly to the putter shaft at 1 inch inward from the tip end; and wherein the torsional stiffness is an angle of twist when a first 6 inches of the butt end is clamped, a first 1 inch of the tip end is clamped, and a torque load of 1 ft*lb is applied to the clamped tip end.

2. The putter shaft of claim 1, wherein:

the longitudinal plies comprise fibers oriented approximately parallel to a longitudinal axis of the putter shaft; and the bias plies comprise fibers oriented at +/−45 degrees from the longitudinal plies.

3. The putter shaft of claim 1, wherein:

the two partial-length bias plies are tip bias plies; and the tip bias plies extend to 20 inches (or 500 mm) from the tip end.

4. The putter shaft of claim 1, wherein the ratio of the distance between a center of gravity of the putter shaft and the butt end of the putter shaft and the full length of the putter shaft is greater than 45%.

5. The putter shaft of claim 1, wherein:

the putter shaft is hollow and comprises a wall thickness defined by an inner diameter (ID) and an outer diameter (OD); and the wall thickness ranges inclusively between 0.030 inch and 0.100 inch.

6. The putter shaft of claim 1, wherein:

the putter shaft further comprises a tip ID and a tip OD;

the tip ID and the tip OD are measured at the furthest portion of the tip end;

the tip ID ranges inclusively between 0.06 inch and 0.20 inch; and the tip OD ranges inclusively between 0.25 inch and 0.45 inch.

7. The putter shaft of claim 1, wherein:

the putter shaft further comprises a butt ID and a butt OD;

the butt ID and OD are measured at the further portion of the butt end; and the butt OD ranges inclusively between 0.5 inch and 0.7 inch.

8. The putter shaft of claim 1, wherein:

the putter shaft comprises a characterizing ratio selected from the group consisting of:

a ratio of frequency to tip OD that ranges inclusively between 1444 cpm/inch and 3200 cpm/inch, a ratio of torsional stiffness to tip OD that ranges inclusively between 1.0 degrees/(ft*lb*inch) and 4.0 degrees/(ft*lb*inch), a ratio of frequency to shaft mass that ranges inclusively between 4.0 cpm/gram and 8.0 cpm/gram, and a ratio of torsional stiffness to shaft mass that ranges inclusively between 0.003 degrees/(ft*lb*gram) and 0.010 degrees/(ft*lb*gram).

9. The putter shaft of claim 8, wherein:

the putter shaft comprises a frequency ratio between 5.5 and 8; and the ratio is calculated by the following equation:

$$R_F = \frac{\text{Frequency}}{10{,}000 \times (\text{Tip } OD) + \text{Shaft Mass}}.$$

10. The putter shaft of claim 8, wherein:

the putter shaft comprises a torsional stiffness ratio between 0.004 and 0.010; and the torsional ratio is calculated by the following equation:

$$R_T = \frac{\text{Tortional Stiffness}}{10{,}000 \times (\text{Tip } OD) + \text{Shaft Mass}}.$$

11. The putter shaft of claim 1, wherein:

the putter shaft comprises a stiffness ratio between 650 and 1600; and the stiffness ratio is calculated by the following equation:

$$R_S = \frac{\text{Frequency}}{\text{Torsional Stiffness}}.$$

12. A putter shaft comprising:

a tubular body comprising:

a plurality of bias plies and a plurality of longitudinal plies;

wherein: the plurality of bais plies comprise a graphite composite with a modulus greater than 60 msi and the plurality of longitudinal plies comprise a graphite composite with a modulus value between 54 msi and 56 msi, a tip end; and a butt end;

wherein:

the putter shaft has a length, measured between the tip end and the butt end, that is inclusively between 32 inches and 38 inches;

the putter shaft has a shaft mass inclusively between 115 grams and 135 grams;

the putter shaft comprises at least 6 full length plies;

at least 4 of the full length plies comprise a modulus value of at least 60 msi; and the putter shaft comprises an ultra-high stiffness as evidenced by:

a frequency value of greater than 650 cpm;

a tip deflection of less than 1.0 inch (2.54 cm); and a torsional stiffness of less than 1.5 degrees;

wherein the frequency value is the number of oscillations that the tip end undergoes per minute when a first 6 inches of the butt end is clamped, a 205 gram weight is attached onto the tip end, and the tip end has been displaced and released; wherein the frequency value is measured within the first 2 to 10 oscillation cycles;

wherein the tip deflection is the perpendicular displacement of the tip end of the putter shaft from an at-rest position of the putter shaft when a first 6 inches of the butt end is clamped and a 3.9 lb load is applied perpendicularly to the putter shaft at 1 inch inward from the tip end; and wherein the torsional stiffness is an angle of twist when the putter shaft a first 6 inches of the butt end is clamped, a first 1 inch of the tip end is clamped, and a torque load of 1 ft*lb is applied to the clamped tip end.

13. The putter shaft of claim 12, wherein:

the putter shaft is hollow and comprises a wall thickness defined by an inner diameter (ID) and an outer diameter (OD);

the wall thickness ranges inclusively between 0.030 inch and 0.100 inch;

the putter shaft further comprises a tip ID and a tip OD;

the tip ID and the tip OD are measured at the furthest portion of the tip end;

the tip ID ranges inclusively between 0.06 inch and 0.20 inch; and the tip OD ranges inclusively between 0.25 inch and 0.45 inch.

14. The putter shaft of claim 12, wherein:

the putter shaft further comprises a butt ID and a butt OD;

the butt ID and butt OD are measured at the further portion of the butt end; and the butt OD ranges inclusively between 0.5 inch and 0.7 inch.

15. The putter shaft of claim 14, wherein:

the putter shaft comprises a characterizing ratio selected from the group consisting of:

a ratio of frequency to tip OD that ranges inclusively between 1444 cpm/inch and 3200 cpm/inch, a ratio of torsional stiffness to tip OD that ranges inclusively between 1.0 degrees/(ft*lb*inch) and 4.0 degrees/(ft*lb*inch), a ratio of frequency to shaft mass that ranges inclusively between 4.0 cpm/gram and 8.0 cpm/gram, and a ratio of torsional stiffness to shaft mass that ranges inclusively between 0.003 degress/(ft*lb*gram) and 0.010 degrees/(ft*lb*gram).

16. The putter shaft of claim 14, wherein:

the putter shaft comprises a characteristic ratio selected from the group consisting of: a frequency ratio ($R_F$), a torsional stiffness ratio ($R_T$), and a stiffness ratio ($R_S$);

the frequency ratio ($R_T$) ranges inclusively between 5.5 and 8;

the frequency ratio ($R_T$) is calculated by the following equation:

$$R_F = \frac{\text{Frequency}}{10{,}000 \times (\text{Tip } OD) + \text{Shaft Mass}};$$

the torsional stiffness ratio ($R_T$) ranges inclusively between 0.004 and 0.010;

the torsional stiffness ratio ($R_T$) is calculated by the following equation:

$$R_T = \frac{\text{Torsional Stiffness}}{10{,}000 \times (\text{Tip } OD) + \text{Shaft Mass}};$$

the stiffness ratio ($R_S$) ranges inclusively between 650 and 1600; and the stiffness ratio ($R_S$) is calculated by the following equation:

$$R_S = \frac{\text{Frequency}}{\text{Torsional Stiffness}}.$$

17. A putter shaft comprising:

a tubular body comprising:

a plurality of bias plies and a plurality of longitudinal plies;

wherein: the plurality of bais plies comprise a graphite composite with a modulus greater than 60 msi and the plurality of longitudinal plies comprise a graphite composite with a modulus value between 54 msi and 56 msi;

a tip end; and a butt end;

wherein:

the putter shaft has a length, measured between the tip end and the butt end, that is inclusively between 32 inches and 38 inches;

the putter shaft is hollow and comprises a wall thickness defined by an inner diameter (ID) and an outer diameter (OD);

the putter shaft further comprises a tip ID and a tip OD;

the tip ID and the tip OD are measured at the furthest portion of the tip end;

the putter shaft comprises an ultra-high stiffness as evidenced by a frequency value of greater than 650 cpm and a frequency ratio (RF) between 5.5 and 8;

the frequency value of the putter shaft is the number of oscillations that the tip end undergoes per minute when a first 6 inches of the butt end is clamped, a 205 gram weight is attached onto the tip end, and the tip end has been displaced and released; wherein the frequency value is measured within the first 2 to 10 oscillation cycles; and the frequency ratio is calculated by the following equation:

$$R_F = \frac{\text{Frequency}}{10{,}000 \times (\text{Tip } OD) + \text{Shaft Mass}}.$$

18. The putter shaft of claim 17, wherein:

the putter shaft has a shaft mass inclusively between 115 grams and 135 grams;

the tip ID ranges inclusively between 0.06 inch and 0.20 inch;

the tip OD ranges inclusively between 0.25 inch and 0.45 inch.

19. The putter shaft of claim 17, wherein:

along at least 50% of the putter shaft length, the OD of the putter shaft varies according to the following equation:

$$y=0.011x+0.345$$

with x equaling the distance from the tip end; and with y equaling the OD of the putter shaft.

* * * * *